United States Patent [19]

Thompson

[11] 4,378,832

[45] Apr. 5, 1983

[54] GOLF CLUB COVER

[75] Inventor: Albert N. Thompson, Winnipeg, Canada

[73] Assignee: M.H.A. Enterprises Ltd., Manitoba, Canada

[21] Appl. No.: 245,760

[22] Filed: Mar. 20, 1981

[30] Foreign Application Priority Data

Mar. 21, 1980 [CA] Canada ..... 348172

[51] Int. Cl.[3] ..... B65D 65/04; B65D 65/06; A63B 53/00

[52] U.S. Cl. ..... 150/52 G; 150/1.5 R

[58] Field of Search ..... 150/52 G, 1.5 R, 1.5 B, 150/1.5 C; 206/315 R

[56] References Cited

U.S. PATENT DOCUMENTS

| | | | |
|---|---|---|---|
| 2,508,525 | 5/1950 | LeFeure | 150/52 G |
| 2,705,039 | 3/1955 | Halter | 150/52 G |
| 2,867,257 | 1/1959 | Cort | 150/1.5 R |
| 2,950,748 | 8/1960 | Olinghouse | 150/1.5 R |
| 3,051,210 | 8/1962 | Mesinger | 150/52 G |
| 3,117,609 | 1/1964 | Pio | 150/52 G |
| 3,613,760 | 10/1971 | Koehnle | 150/52 G |
| 3,664,399 | 5/1972 | Neff | 150/52 G X |
| 3,892,267 | 7/1975 | Bibeau | 150/52 G |
| 4,173,241 | 11/1979 | Stock | 150/52 G X |
| 4,195,677 | 4/1980 | Hagg et al. | 150/52 G |

*Primary Examiner*—William Price
*Assistant Examiner*—Sue A. Weaver
*Attorney, Agent, or Firm*—Antonelli, Terry & Wands

[57] ABSTRACT

A golf club cover of the type of rigid half-shells hingedly secured to each other has several improvements directed to render the product more useful and convenient in application. The head portion is perforated to allow drying of wet club head thus avoiding the damage, particularly to woods, due to high humidity normally retained within the cover. The cover is maintained in closed state by closure means that does not obstruct other clubs or covers in a bag. The suspension cord eyelet is located such as to minimize the occurrence of the cord obstructing the interior of the cover. The end of the shank portion of the cover has an inwardly turned flange defining a drop-shaped opening to facilitate the centering of a shank within the cover as the cover is being applied.

2 Claims, 7 Drawing Figures

GOLF CLUB COVER

BACKGROUND OF THE INVENTION

The present invention relates to a golf club cover and more particularly to the golf club cover of the type of a pair of generally identical rigid shells hingedly secured to each other, as opposed to "soft" golf club covers such as disclosed, for instance, in Canadian Pat. No. 522,497 issued Mar. 6, 1956 to Halter, or in Canadian Pat. No. 660,831 issued Apr. 9, 1963 to Mesinger. Prior art related to golf club covers comprised of two hinged, rigid half-shells is typically represented by U.S. Pat. No. 2,508,525 issued May 23, 1950 to Lefevre, and by U.S. Pat. No. 3,117,609 issued Jan. 13, 1964 to Pio.

The last two mentioned U.S. patents present a trend in the art of golf club covers, directed to replace pliable, soft covers with a hard shell that would effectively protect the head of a golf club against scratching and other mechanical damage when the golf club is not in use. If the golf club cover is to be of the type of a rigid shell, it is unavoidable to design the cover such that it is comprised of two more or less identical halves hingedly secured to one another. In U.S. Pat. No. 2,508,525, the hinged securement is effected by a spring-urged hinge near the tip of a bulbous head covering portion of the cover. It is believed that the arrangement is disadvantageous particularly due to the fact that if the golf club cover is being placed over the golf club, the hinge has to be grasped and maintained in an open state, against the action of the spring. The spring in the hinge is obviously also effective as means for maintaining the cover in a closed state. Such kind of hinge is believed to be disadvantageous in that the need for forcing the two halves into an open state against the action of the hinge spring fully occupies one hand of the user thus making the placement of the golf club head within the cover relatively cumbersome. Moreover, the hinge arrangement near the tip of the bulbous head portion of the cover presents a protruding portion which may easily become damaged or may itself cause scratching or the like damage to the remaining golf clubs in a golf club bag.

It is therefore believed that the type of the rigid cover as described in the Pio patent is more advantageous not only due to the location of the hinge which is coextensive with the back of the shank portion of the cover, but also due to the fact that it allows for opening of the cover and retaining the cover in an open state without the need for forcing the two halves apart to maintain them in an open state.

It has further been established that despite the knowledge of hard shell covers for golf clubs, the covers did not find a broad application among the golfers, despite obvious advantages of such covers over the soft pliable sock-type covers. It is known that many golfers having tried the hard shell covers eventually switched back to soft pliable cover for all kinds of reasons, beginning with cumbersome operation of the covers to the fact that golf club heads may deteriorate within a hard shell cover due to its tendency of retaining moisture within the shell.

It is therefore an object of the present invention to provide further improvements of the art of golf club covers generally of the type as described in the above U.S. Patent to Pio.

SUMMARY OF THE INVENTION

In general terms, the golf club cover of the present invention is of the type of a pair of generally identical rigid shells hingedly secured to each other to provide an enclosed hollow cover padded inside and having a bulbous head portion merging with an elongate shank portion for covering a head and an adjacent portion of the shank of a gulf club; releasable means for releasably maintaining the cover in a closed state; eyelet means integral with one half shell for receiving a coupling cord; hinge means extending along the shank portion and along a rear part of the head portion; wherein the head portion is provided with vent means disposed in side sections of each of the half shells. The vent means is preferably comprised of a series of vent passages in the wall of each of said half shells, each vent communicating, at the interior of the respective half shell, with a recess in a padding, the area of each recess as viewed in the direction of the respective passage being greater than that of the respective passage.

According to another feature of the present invention, the eyelet means is generally integral with a rim of a head section of one of said half shells and is disposed near that portion of the rim which is adjacent to said hinge means. According to another feature of the present invention the hinge means is of the type of a double action hinge of the type including resilient means adapted to yieldably maintain the half shells in a fully opened position and to resiliently keep the halves in a closed state at the closed position, whereby said releasable means is included in said hinge means within the cover. In a modified version, the releasable means is of the type of a fastener means having an engaging fastener portion secured to one half shell, and an engaged fastener portion secured to the other half shell; said fastener means being disposed at said head portion near a merger thereof with said shank portion at that side of the cover which is remote from said hinge means.

According to yet another feature of the present invention, the end of said shank portion remote from the head portion comprises an inwardly turned flange for centering the shank of a golf club within the said shank portion, said flange portion defining an end opening which is of a drop-shaped end view configuration, convergent in the direction transversely away from the hinge means.

BRIEF DESCRIPTION OF THE DRAWINGS

The invention will be described in greater detail by way of two preferred embodiments, with reference to the accompanying drawings wherein.

DETAILED DESCRIPTION OF PREFERRED EMBODIMENTS

Figure 1:
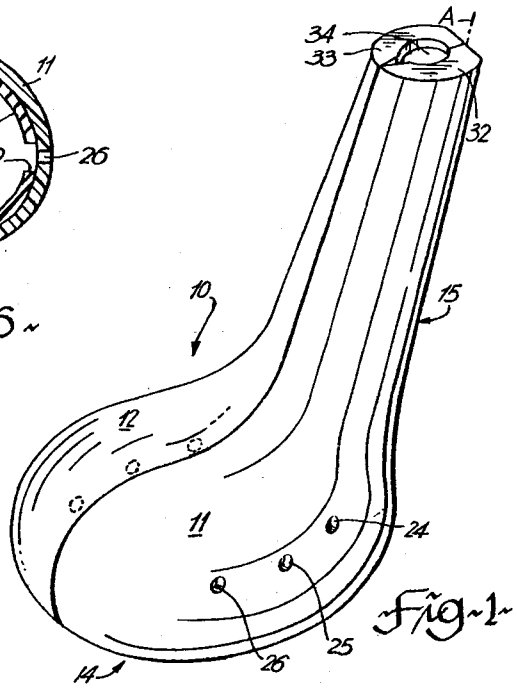
FIG. 1 is a perspective view of a golf club cover according to the present invention, in a first embodiment.
Figure 2:
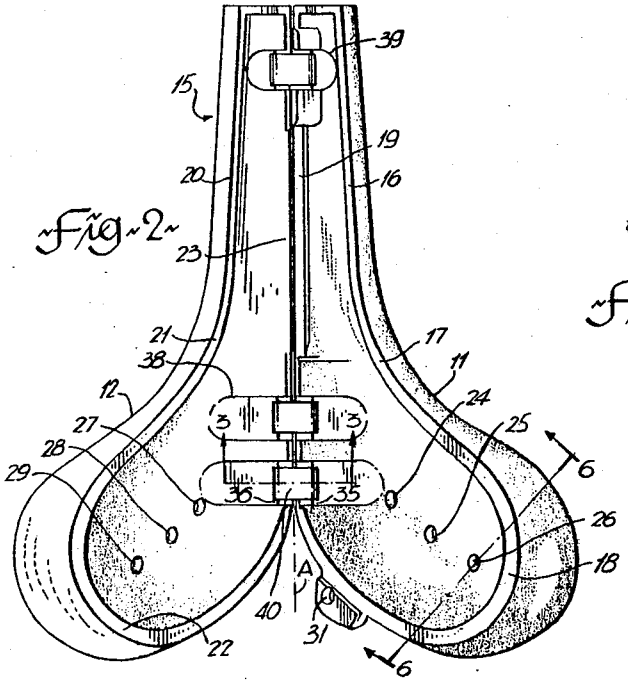
FIG. 2 is a simplified view (with the padding inside the cover removed for the sake of clarity) of the cover of FIG. 1, showing same in an open state.

Dealing firstly with FIGS. 1 and 2, a golf club cover generally designated with reference numeral 10 is shown which is made of a pair of generally identical rigid half-shells 11, 12 molded from nylon. The two half-shells 11, 12 are secured to each other by hinge means adapted for hinged pivotal movement about a hinge axis A from a fully opened state as shown in FIG. 2 to a fully closed state indicated in FIG. 1. Each of the half-shells 10, 11 is provided, at the interior thereof with a padding 13, for instance from a styrene foam or the like, adhesively secured to the interior wall of the half-shells 12, 11. The padding is only shown in FIG. 6 but it will be appreciated that the disposition of the padding within the half-shells can be effected in many different ways, the function of the padding of course, being to form a interlayer between the hard half-shell inner surface and the golf club head. In a closed state, the cover forms an integral body comprised of a hollow bulbous head portion 14 which merges with a hollow elongate shank portion 15. The exterior (and the interior) shape of the cover thus resembles generally the shape of the head end of a golf club. The cavity defined by the half-shell 11 terminates at a peripheral, generally planar rim comprised of a straight downwardly extending portion 16 of the shank section of the half-shell, which merges over a curved joinder 17 between the bulbous and shank portions of the cover with a rounded head section 18 of the rim which extends back to a generally straight section 19 extending generally parallel with the hinge axis A end coincident with a hinge means to be described later on.

The contour of the opening in the half shell 12 is similarly defined by a peripheral rim comprised of a shank section 20, a joinder portion 21, a head section 22 and a straight section 23 generally parallel with the straight section 19 and with the axis A.

The half-shell 11 is provided with three vents 24, 25 and 26 and the opposite half shell 12 has similar vents 27, 28 29. All of the vents 24–29 are of the type of a circular hole approximately 3 mm in diameter.

Figure 6:
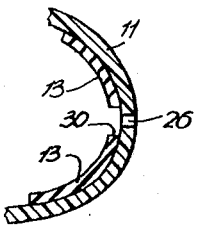
FIG. 6 (on the sheet of FIG. 1) is a partial cross-sectional view 6—6 of FIG. 2 of a part of the shell, inclusive a padding that is not shown in FIG. 2.

As shown in FIG. 6 only, the interior padding 13 is provided with a recess 30. In the embodiment shown in FIG. 6, a circular cutout coaxial with the vent 26 and having diameter of approximately 15 mm (FIG. 6 is not to scale on this point) is provided in the padding 13. This arrangement is preferred to allow the free passage of air between the vents 24–29. As is known, the padding 13 normally does not snugly engage the golf club head so that sufficient space is left between the padding and the head.

The half-shell 11 is provided with an eyelet 31 which is strategically located at a position generally coincident with the head section 18 of the rim adjacent to the hinge axis A. The passage in the eyelet 31 normally receives a coupling cord (not shown) which, in use, suspends the cover when same is not in use, so that when a golf club is to be reinserted into the cover, the cover is readily accessible near the top of the bag, the coupling cord being also threaded through eyelets of covers of other golf clubs within the bag, as is well known.

The location of the eyelet 31 enhances convenience in use of the present invention due to the fact that when the cover is suspended by the eyelet located as disclosed, the cord is maintained at a location outside of the cavity of the cover, regardless whether the cover is in open or closed position. This simple modification thus enhances the convenience of use of the cover according to the present invention.

The end of the shank portion 15 includes two inwardly turned flanges 32, 33 which, with the cover closed, define a drop shaped opening 34 (FIG. 1) concavely rounded near the hinge axis A and convergent in a direction away from axis A towards the joinder formed by abutting portions 16,20 of the shank sections of the rims as described above. This arrangement provides an added convenience in that, firstly, the opening 34 centers the shank of a golf club within the shank portion 15. The convergent portion of the drop-shaped opening assists in pushing a partly offset shank of a club to a centered position as the two halves are being closed.

The hinge means used in the embodiments shown in FIGS. 1 and 2 will now be described in greater detail with particular reference to FIGS. 3*a* and 3*b*.

As is apparent from FIG. 2, the hinge means is of the type of a resilient hinge which is also referred to as a "double action hinge". In other words, the hinge normally urges the two halves 11, 12 to a closed state in FIG. 1 while, upon reaching the fully opened state shown in FIG. 2, the hinge comprises means for maintaining the cover in such open position.

Figures 3A, 3B, 4, 5:
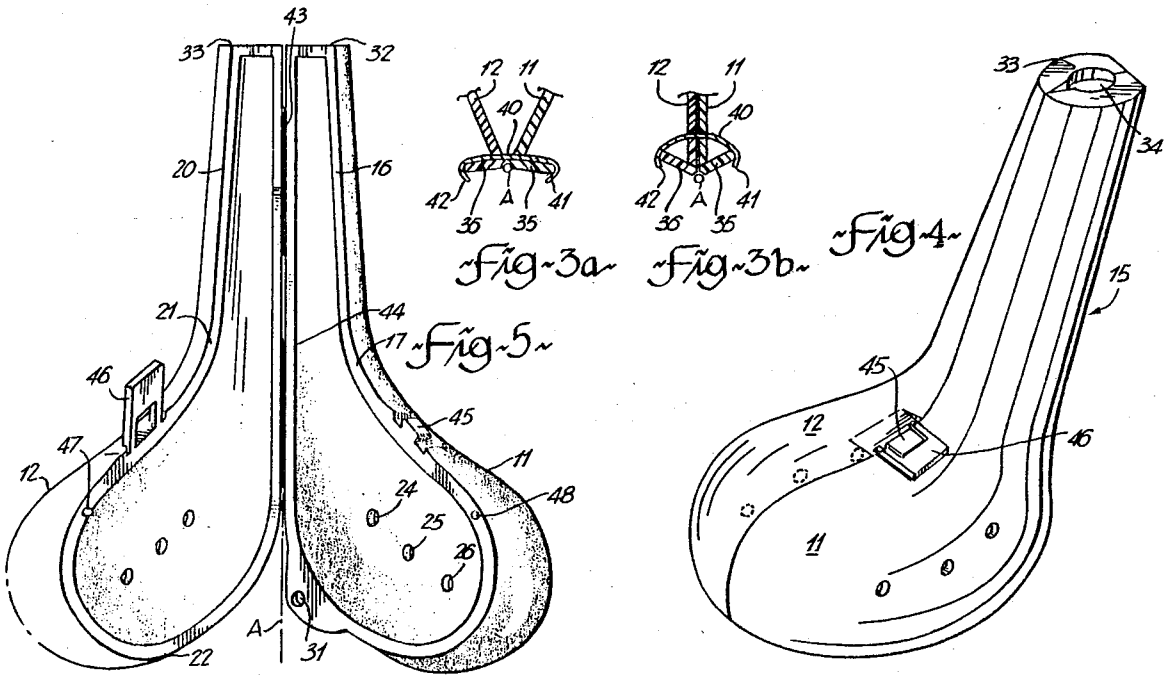
FIGS. 3*a* and 3*b* are diagrammatic representations of section 3—3 in FIG. 2, showing the hinge of the cover in an open and closed state, respectively.
FIG. 4 is a perspective view similar to FIG. 1 but showing another embodiment.
FIG. 5 is similar to FIG. 2 but relating to the embodiment of FIG. 4.

The hinge shown in FIG. 2 and FIGS. 3*a* and 3*b* has been known in many different fields. It is also to be emphasized at this point that the hinge shown in FIGS. 2 and 3 is merely an example of a double action hinge which can be substituted by many other different kinds of the hinge. In general, and referring to the diagrammatic representation in FIGS. 3*a* and 3*b*, the two halves 11, 12 are pivotal relative to each other generally about the axis A, the representation of the axis A in FIGS. 3 being by way of a large circular dot. The large circular dot simply indicates that the two halves 11, 12 can pivot relative to each other, generally about the axis A. The dot may, in actual embodiment, assume all kinds of hinged securements. For instance, the item A in FIGS. 3*a* and 3*b* may represent a classical hinge with the hinge pin passing through, or, it may simply represent a groove-and-tongue engagement parallel with axis A and allowing for pivotal movement of the parts 11 and 12 about the axis A.

With reference to FIG. 2 and FIGS. 3*a* and 3*b*, each of the halves 11, 12 has an outwardly protruding angular shoulder 35, 36, each extending a limited axial length relative to the hinge axis A, generally transversely of the oval region 37 as shown in FIG. 2. Referring to FIG. 2, there are additional similar oval regions 38, 39 each containing an arrangement identical to that shown in cross sectional configuration in FIGS. 3*a* and 3*b*.

The shoulders 36, 35, are spanned by a generally inverted U-shaped spring steel clip 40 having inwardly turned lips 41, 42, at each free end thereof. The dimension of the clip 40 is determined such that the clip is pretensioned at all times. In other words, at any position of the shoulders 35, 36, the clip tends to contract such as to bring the lips 41, 42 closer to each other. In a fully opened state, as shown in FIG. 3*a*, the upper surface of each of the shoulders 41, 42 contacts the interior surface of the clip, while the lips 41, 42 remain engaged with the exterior ends of the shoulders 35, 36. Accordingly, any movement directed to further spread the halves 11, 12 apart, is now prevented by the clip 40. By the same token, since the axis A of pivot of the hinge is now within the inverted "U" of the clip the force urging the lips 41, 42 urges the upper surfaces of shoulders 35, 36 to engage the inside of the clip. When pressure is applied to the halves 11, 12 directed to close the cover, the hinge axis A eventually reaches a position outside the cross sectional area of the "U" of the strap, whereupon the aforesaid contracting action forces the shoulders 35, 36 in a direction result in a closing movement of halves 11, 12. The terminal position is shown in FIG. 3*b*, at which the lips 41, 42 are still urged by the springy clip 40 towards each other, thus resiliently holding the halves 11, 12 closed. Thus, the hinge is of the type of a "double action" hinge since, in one state, the hinge is maintained resiliently in an open state, while in the other terminal position, the hinge is resiliently maintained in a closed state. It is to be emphasized again that the double action hinge per se is known and is not claimed as an invention. The application of such hinge in the art of the above type of golf club covers, however, has now been considered by those skilled in the art, even though it results in considerable advantages as it facilitates the insertion of the golf club into the cover and, at the same time, avoids the need for any exterior fasteners normally required to hold the cover in a closed state.

Turning now to the embodiment of FIGS. 4 and 5, the second embodiment corresponds in many respects to the arrangement of the previously described embodiment with the exception of hinge means which, in this case, is comprised of flexible nylon hinge sections 43, 44 integral with the half shells 11, 12. In the second embodiment, the double action hinge of the embodiment of FIGS. 1 and 2 has been replaced by a snap-on fastener comprised of a rectangular protrusion 45, integral with the half shell 11, and with a complementary rectangular yoke 46 hingedly secured to and integral with the half shell 12. In general terms, therefore, it can be said that the releasable means is of the type of a fastener whose engaging portion is formed by the yoke 46 and engaged portion by the protrusion 45.

The location of the fastener 45, 46 can best be appreciated when referring to the location of the protrusion 45 as shown in FIG. 5. It will be seen that the protrusion 45 and thus the fastener itself is located at the portion of the peripheral rim forming the head of the cover. It is located slightly below the joinder portion 17 which is intermediate between the shank and the head of the cover located opposite to or remote from the hinge section 44. In general terms, therefore, the fastener means can be defined as being disposed at the head portion near a merger thereof with the shank portion at that side of the cover which is opposite to the hinge means.

It is useful to provide the embodiment of FIG. 5 with a centering pin 47 which, with the cover closed, engages an opening 48 in the opposite half-shell to reinforce the joint between the two halves in the closed state.

The location of the fastener means 45, 46 as is of advantage as it is, on the one hand, readily accessible for releasing or engagement, by the same token, the strategic location makes it virtually impossible for the fastener 45, 46 to be exposed to undesired mechanical impact by adjacent golf clubs or other covers.

The remaining portions of the embodiment of FIGS. 4 and 5 as shown are virtually identical to those shown in the embodiment of FIGS. 1 and 2 and are therefore referred to with the same reference numerals.

Those skilled in the art will readily appreciate that many other modifications may exist of the embodiment of FIGS. 1, 2, 4 and 5 without departing from the scope of the present invention as recited in the accompanying claims.

The embodiments of the invention in which an exclusive property or privilege is claimed are defined as follows:

1. A golf club head cover comprising a pair of generally mirror-imaged rigid half-shells, each of said half-shells being provided with an internal padding, hinge means extending along a stem portion and a rear part of a head portion of a rim of each half-shell for hingedly securing the pair of half-shells together, and releasable latch means for releasably maintaining the half-shells in a closed state wherein an enclosed cavity, of a shape having a bulbous head portion merging with an elongate stem portion, is defined for covering a head and adjacent shank of a single golf club; wherein a series of vent passages are provided extending through each half-shell and the internal padding thereof for communicating said cavity with the exterior of the head cover; and wherein a shank end of each of the half-shells has an inwardly directed flange with a golf club shank centering recess therein, said recesses defining together, in said closed state of the half-shells, an end opening which, in end view, is drop-shaped, having a rounded portion directed toward the portion of the rim along which the hinge means extends and a covergent portion converging in a direction transversely away from the hinge means, whereby a partly offset shank of a club will be pushed to a centered position as the half-shells are brought from an open state into said closed state.

2. A golf club cover according to claim 1, wherein each of said vent passages comprises an opening in a wall of a half-shell that communicates with a cut-out in the respective half-shell padding, the cross-sectional area of each recess being substantially greater than the cross-sectional area of the opening in the half-shell wall for allowing the free passage of air between the vent passages.

* * * * *